US010780567B2

(12) United States Patent
Wong et al.

(10) Patent No.: US 10,780,567 B2
(45) Date of Patent: Sep. 22, 2020

(54) ACCESSORY ATTACHMENT FOR DRIVEN FASTENER HAND TOOL

(71) Applicants: Raymond Wong, Alhambra, CA (US); Shih-Yi Chen, Taoyuan (TW); Chin-Chuan Chen, Taoyuan (TW)

(72) Inventors: Raymond Wong, Alhambra, CA (US); Shih-Yi Chen, Taoyuan (TW); Chin-Chuan Chen, Taoyuan (TW)

(73) Assignee: Power Tech Staple and Nail, Inc., Monterey Park, CA (US)

( * ) Notice: Subject to any disclaimer, the term of this patent is extended or adjusted under 35 U.S.C. 154(b) by 248 days.

(21) Appl. No.: 15/725,170

(22) Filed: Oct. 4, 2017

(65) Prior Publication Data

US 2018/0099400 A1 Apr. 12, 2018

Related U.S. Application Data

(60) Provisional application No. 62/406,356, filed on Oct. 10, 2016.

(51) Int. Cl.

| | |
|---|---|
| ***B25F 5/02*** | (2006.01) |
| ***B25C 7/00*** | (2006.01) |
| ***B25C 1/00*** | (2006.01) |
| ***B25C 1/18*** | (2006.01) |

(52) U.S. Cl.

CPC ..... *B25F 5/021* (2013.01); *B25C 1/00* (2013.01); *B25C 1/188* (2013.01); *B25C 7/00* (2013.01)

(58) Field of Classification Search

CPC . B25F 1/02; B25F 5/021; B25C 1/188; B25C 7/00

USPC ..... 227/148

See application file for complete search history.

(56) References Cited

U.S. PATENT DOCUMENTS 2,745,689 A * 5/1956 Balint ..... G05G 1/12 403/357
3,827,822 A * 8/1974 Converse ..... B25H 1/0078 408/110
3,853,257 A * 12/1974 Perkins ..... B25C 5/06 227/123
5,261,587 A * 11/1993 Robinson ..... B25C 1/08 227/142
5,261,588 A 11/1993 Lin
(Continued)

*Primary Examiner* — Robert F Long
*Assistant Examiner* — Xavier A Madison
(74) *Attorney, Agent, or Firm* — Canady & Lortz LLP; Bradley K. Lortz

(57) ABSTRACT

An accessory attachment for a driven fastener hand tool is disclosed comprising a mounting block having an attachment channel and an indexing guide feature. A plate for covering a fastener driving channel of the fastener tool has a nose end with chamfered edges on opposing sides towards the fastener driving channel and the attachment channel has opposing lips for seating against the chamfered edges of the nose end of the plate. One or more bolts through the mounting block at a bottom of the attachment channel press the nose end of the plate causing the opposing lips of the mounting block to press against the chamfered edges thereby securing the mounting block to the nose end of the plate. Alternately or additionally, the mounting block can be used to support a range of accessories including, a non-marring pad, a light, such as an LED, a level, and/or an edge guide.

17 Claims, 9 Drawing Sheets

(56) References Cited

U.S. PATENT DOCUMENTS

| | | | | |
|---|---|---|---|---|
| 5,405,071 | A * | 4/1995 | Baugus | B25C 1/047 227/140 |
| 6,988,648 | B2 * | 1/2006 | Taylor | B25C 1/008 227/142 |
| 7,055,728 | B2 | 6/2006 | Lin | |
| 7,331,685 | B2 * | 2/2008 | Shen | B25C 7/00 362/119 |
| 7,575,140 | B2 | 8/2009 | Jiang | |
| 7,654,430 | B2 | 2/2010 | Cho et al. | |
| 8,056,785 | B2 * | 11/2011 | Gosis | B25C 7/00 227/140 |
| 2004/0011845 | A1 | 1/2004 | Walter | |
| 2005/0189394 | A1 * | 9/2005 | Terrell | B25C 5/1665 227/130 |
| 2006/0112580 | A1 * | 6/2006 | DeKeyser | B25C 7/00 33/626 |
| 2009/0072005 | A1 * | 3/2009 | Cortez | B25C 7/00 227/130 |
| 2009/0152323 | A1 | 6/2009 | Lin | |
| 2009/0277032 | A1 * | 11/2009 | Grant | B25C 7/00 33/645 |
| 2011/0062209 | A1 * | 3/2011 | Vallon | B25C 1/00 227/110 |

* cited by examiner

ACCESSORY ATTACHMENT FOR DRIVEN FASTENER HAND TOOL

CROSS-REFERENCE TO RELATED APPLICATIONS

This application claims the benefit under 35 U.S.C. § 119(e) of the following U.S. provisional patent application, which is incorporated by reference herein:

U.S. Provisional Patent Application No. 62/406,356, filed Oct. 10, 2016, and entitled "NOSE GUIDE FOR DRIVEN FASTENER HAND TOOL," by Wong et al.

BACKGROUND OF THE INVENTION

1. Field of the Invention

This invention relates to driven fastener hand tools. Particularly, this invention relates to accessory attachment for driven fastener hand tools.

2. Description of the Related Art

Powered fastener driving tools, e.g. nail guns, have existed for decades. Perhaps not coincidentally, the first commercial nail gun was introduced in 1950 after World War II wherein the technology for rapidly firing projectiles was greatly advanced. The first nail guns were pneumatic, driven by compressed air. Although pneumatic power is still the most prevalent, over time fastener driving tools have been developed using other means of power, such as electric motors, solonoids, combustibles, e.g gas or explosive powder, have also been developed. Some development of technology related to powered fastener drivers, and particularly combustion driven fastener tools has occurred. However, there is still much need for further development.

Beyond the tool itself, there are various supporting devices that may assist in the operation of driven fastener hand tools. For example, a guide device can assist a user with proper positioning of the delivered fastener such that the driven fastener hand tool can be operated more quickly but still with precise placement of the fasteners. Positioning guides for driven fastener hand tools have been previously developed to locate the fastener position relative to feature having a fixed relationship to the fastener deliver point. However, previous guides for have been cumbersome and bulky, often being affixed to the driven fastener hand tool.

For example, U.S. Pat. No. 7,344,057, issued Mar. 18, 2008, by Dion et al. discloses a nailer comprises a main body, an elongated nail ejection channel in the main body for receiving a nail to be ejected and including a nail outlet leading out of the main body, and a plunger carried within and movable along, the nail ejection channel. The nailer also includes an actuator capable of moving the plunger along an ejection axis in the nail ejection channel for selectively ejecting the nail out through the nail outlet. A first guide member is carried by and movable relative to the main body, for engaging a first reference surface outboard of the nailer, and a first adjuster mechanism capable of adjusting the position of the first guide member relative to the main body is also provided. The position of the nail ejection channel can be adjusted relative to the first reference surface with the first adjuster mechanism when the nailer engages the first reference surface with the first guide member.

Guides for a driven fastener hand tool have also been developed employing a specially formed contact tip. U.S. Pat. No. 8,627,991, issued Jan. 14, 2014, by Francis et al. and U.S. Pat. No. 8,387,846, issued Mar. 5, 2013, by Francis et al. both disclose a blind guide work contact tip for mounting to a drive probe of a fastening tool is shaped in a manner which allows for an angled nail placement, such as 45 degree into a workpiece. The blind guide work contact is a one-piece attachment which is fitted around the existing drive probe and includes a body and two wings which extend therefrom forming a channel through which a fastener passes into the workpiece. The body has a work surface with a peak and sloped slides adjacent each side of the peak at approximately 45 degrees. The sloped surfaces allows the blind guide work contact tip to better access corners and angled spaces than previous work contact tips. The work contact tip also has a flat portion at the peak of the work surface so as to not inhibit face nailing.

In view of the foregoing, there is a need in the art for accessory support attachments for driven fastener hand tools. There is a need for such attachments to be simple, removable, and inexpensive. There is also a need for such attachments to be readily adaptable to a range of driven fastener hand tools, capable of being retrofitted to existing driven fastener hand tools. Particularly, there is a need for such accessory attachments for driven fastener hand tools to support a fastener position guide. In addition, there is a need for such accessory attachments to support a range of accessories for use with driven fastener hand tools. These and other needs are met by the present invention as detailed hereafter.

SUMMARY OF THE INVENTION

An accessory attachment for a driven fastener hand tool is disclosed comprising a mounting block having an attachment channel and an indexing guide feature. A plate for covering a fastener driving channel of the fastener tool has a nose end with chamfered edges on opposing sides towards the fastener driving channel and the attachment channel has opposing lips for seating against the chamfered edges of the nose end of the plate. One or more bolts through the mounting block at a bottom of the attachment channel press the nose end of the plate causing the opposing lips of the mounting block to press against the chamfered edges thereby securing the mounting block to the nose end of the plate. Alternately or additionally, the mounting block can be used to support a range of accessories including a non-marring pad, a light, such as an LED, a level, and/or an edge guide.

A typical embodiment of the invention comprises an accessory attachment for a driven fastener hand tool, including a mounting block having an attachment channel, the attachment channel having opposing lips for seating against chamfered edges of a nose end of a plate, the plate for covering a fastener driving channel of the driven fastener tool and having the nose end with the chamfered edges on opposing sides towards the fastener driving channel, and one or more mounting block fasteners disposed through the mounting block at a bottom of the attachment channel to press the nose end of the plate causing the opposing lips of the mounting block to press against the chamfered edges of the nose end of the plate thereby securing the mounting block to the nose end of the plate.

In some embodiments of the invention, the chamfered edges engagement with the opposing lips can fix the position of the mounting block along a length of the plate. The attachment channel of the mounting block can have sufficient depth to allow the opposing lips of the the mounting block to pass over a width of the nose end of the plate.

Typically, the one or more mounting block fasteners can comprise threaded fasteners, such as bolts or screws.

In some embodiments of the invention, a guide feature can be affixed to the mounting block. The guide feature can comprises an edge guide. Alternately, the guide feature can comprise a horizontal post for locating a hole of a shelf support post relative to a fastener location aligned with the fastener driving channel.

In further embodiments of the invention, a non-marring pad is attached to the mounting block. The non-marring pad can comprise a disc shape over a cupped end of the mounting block.

In other embodiments of the invention, a light assembly or a level can be attached to the mounting block. The light assembly can employ an LED light. The level can be configured with a view port in the side or end of a cylinder for aligning fasteners horizonally or vertically, respectively. The mounting block can comprise a cylindrical opening which can support either a light assembly or a level.

BRIEF DESCRIPTION OF THE DRAWINGS

Referring now to the drawings in which like reference numbers represent corresponding parts throughout.

DETAILED DESCRIPTION OF THE PREFERRED EMBODIMENT

1. Overview

As previously mentioned, embodiments of the invention comprise an accessory attachment for a driven fastener band tool. A majority of driven fastener hand tools (regardless of the power source) employ a nose plate at the front of the hand tool which covers the fastener driving channel. Like the barrel of a gun, the fastener driving channel is where the next fastener is positioned to be driven from the fastener clip by the driver (or blade). The nose plate is conveniently removable to allow a user to clear any fasteners if a jam should occur. Embodiments of the invention can be directed to a mounting block which is conveniently attached to the nose plate of a driven fastener hand tool.

A plate for covering a fastener driving channel of the fastener tool has a nose end with chamfered edges on opposing sides towards the fastener driving channel and the attachment channel has opposing lips for seating against the chamfered edges of the nose end of the plate. One or more bolts through the mounting block at a bottom of the attachment channel press the nose end of the plate causing the opposing lips of the mounting block to press against the chamfered edges thereby securing the mounting block to the nose end of the plate.

Embodiments of the invention can be implemented with any suitable driven fastener hand tool which may fire any type of fastener, e.g. staple, brad, nail, etc., and using any known type of driving power, e.g. compressed air, combustion, electric, etc., as will be understood by those skilled in the art.

In one notable example, the accessory attachment supports an indexing fastener position guide for a driven fastener hand tool. The indexing fastener position guide is affixed directly to the nose of the driven fastener hand tool and provides a guide feature located in precise relationship with the entry point of the fastener from the nose of the hand tool. The relative relationship between the guide feature and the fastener entry point is designed to match a specific application.

The described novel system for attachment to any suitable driven fastener hand tool can be used for a mounting block which includes an indexing guide feature for easy alignment of the proper position of the fasteners delivered by the hand tool in use. However, the mounting block can additionally or alternately be used to support a range of possible accessories as well. For example, such alternate accessories include, without limitation, a non-marring pad, a light, such as an LED, a level, and/or an edge guide.

2. Exemplary Driven Fastener Hand Tool Accessory Mounting Block

Figure 1A:
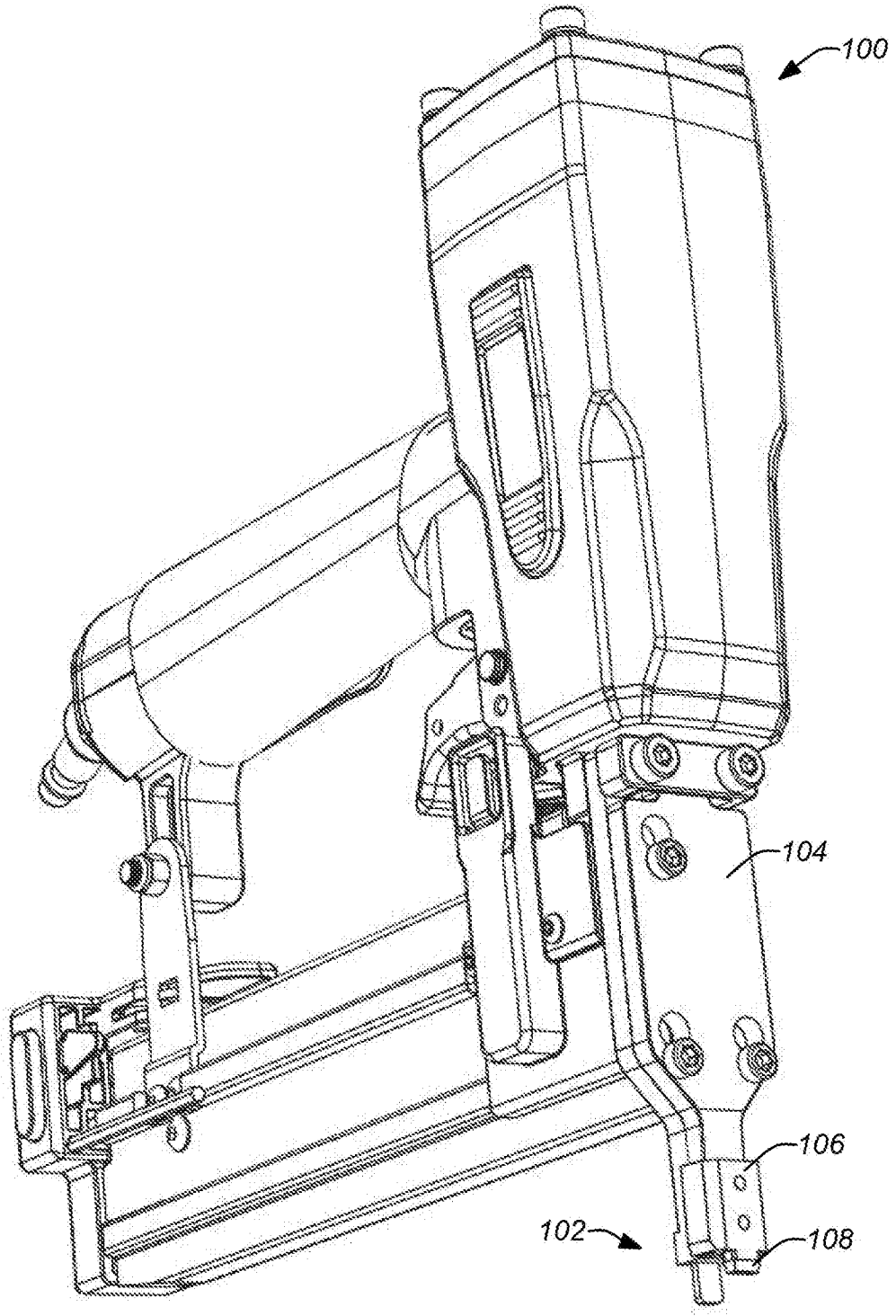
FIGS. 1A and 1B show an example embodiment of the invention for attaching to a nose of a driven fastener hand tool.
Figure 1B:
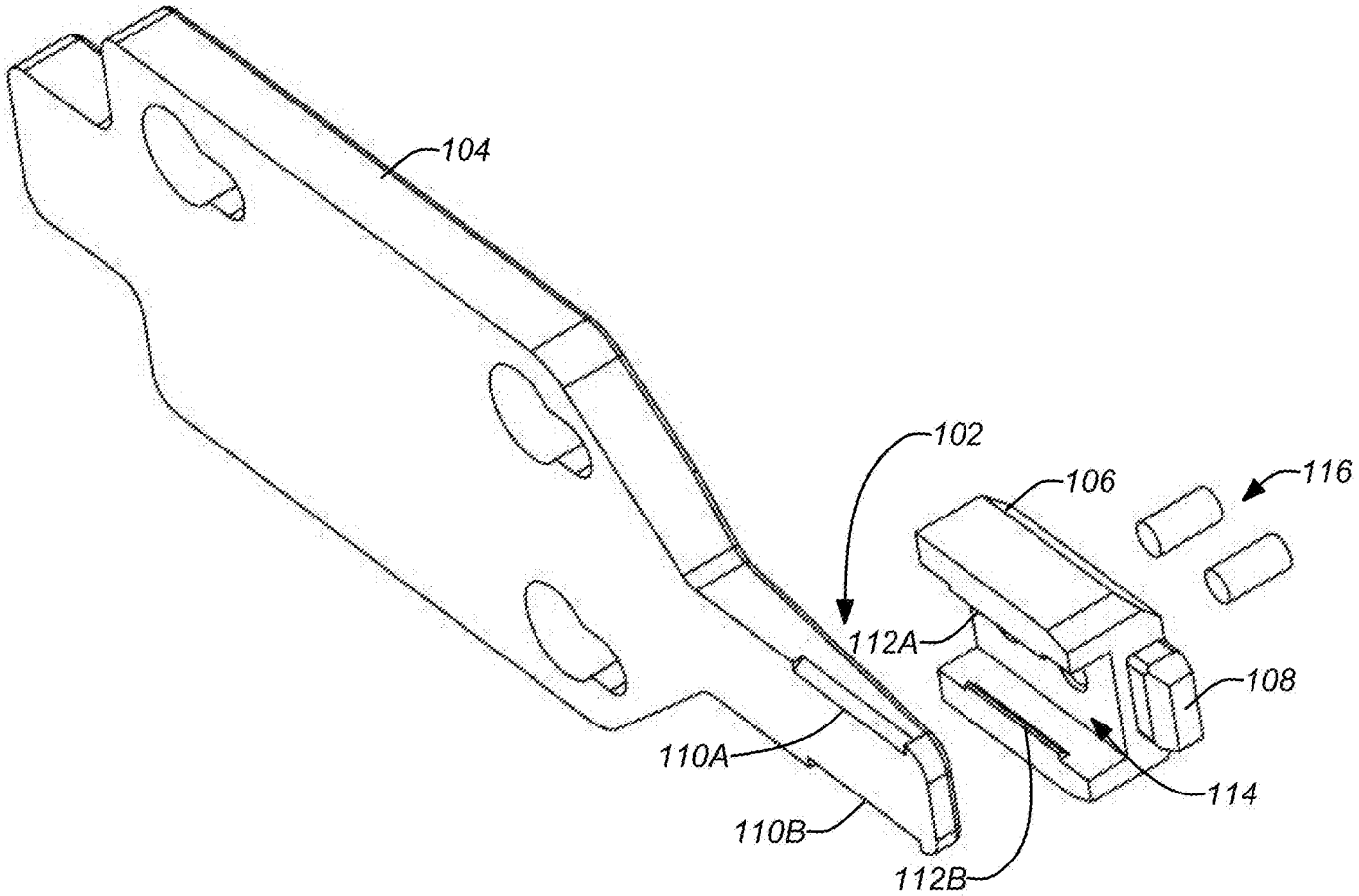

FIGS. 1A and 1B show an example embodiment of the invention attached to a nose 102 of a driven fastener hand tool 100 including an indexing guide. FIG. 1A shows the mounting block 106 attached to the nose plate 104 of the driven fastener hand tool 100 near the entry point of the fastener from the nose of the hand tool 100. The nose plate 104 has an end with chamfered edges 110A, 110B on opposing sides towards the fastener driving channel (shown in FIG. 1B). The mounting block 106 includes an attachment channel 114 which has opposing lips 112A, 112B at the top edges of the attachment channel 114. These opposing lips 112A, 112B seat against the chamfered edges 110A, 110B of the nose end 102 of the plate 104. The opposing lips 112A, 112B are separated from each other by a distance shorter than the width of the nose end 102 of the plate 104. One or more mounting block fasteners 116 (e.g. bolts) are disposed through the mounting block 106 at a bottom of the attachment channel 114 to press against the top surface of the nose end 102 of the plate 104 causing the opposing lips 112A, 112B of the mounting block 106 to press against the respective chamfered edges 110A, 110B of the nose end 102 of the plate 104 thereby securing the mounting block 106 to the nose end 102 of the plate 104.

FIG. 1B shows the mounting block 106 attached to the nose plate 104 and fasteners 116 in an exploded view. Mounting block fasteners 116 (typically bolts or set screws) are shown schematically as cylinders which match cylindrical through holes in the mounting block 106. If threaded elements (such as bolts or set screws) are employed as the mounting block fasteners 116, the mounting block 106 will have threaded through holes in the bottom of the attachment channel 114. The fasteners 116 are then threaded into the threaded through holes of the mounting block 106 and screwed down such that, when the mounting block 106 is properly positioned over the nose end of the nose plate 104, the ends of the fasteners 116 press against the top surface of the nose end 102 of the plate 104 and force the channel 114 away from the top surface of the nose plate 104. This force causes the opposing lips 112A, 112B of the mounting block 106 to engage the chamfered edges 110A, 110B of the nose end 102 of the plate 104 and thereby secure the mounting block 106 in place onto the nose end 102 of the plate 104.

It should be noted that the attachment channel 114 of the mounting block 106 can be made with sufficient depth to allow the opposing lips 112A, 112B of the mounting block 106 to pass over the width of the nose end 102 of the plate 104 (either slipping the mounting block 106 on from the end or hooking one side first with the mounting block 106 canted relative to the plate 104).

The opposing lips 112A, 112B seating against the chamfered edges 110A, 110B of the nose plate 104 secure the mounting block 106 to the nose plate 104. Because the chamfered edges 110A, 110B of the nose plate 104 have a length matching the length of the opposing lips 112A, 112B, the mounting block 106 is secured in a specific vertical location along the nose plate 104. Once secured in place, the mounting block 106 does not slide along the nose plate 104. Additional matching features can also be applied to the opposing lips 112A, 112B and chamfered edges 110A, 110B, e.g. one or more grooves and ridges on the opposing lips 112A, 112B and matching one or more ridges or grooves on the chamfered edges 110A, 110B, to lock the mounting block 106 to the nose plate 104 in a fixed vertical position when the fasteners 116 are engaged to press these two elements together. The rigid form of the mounting block and fixed dimensions of the opposing lips 112A, 112B with chamfered edges 110A, 110B of the nose plate 104 also lock the mounting block 106 to the nose plate in a fixed horizontal position when the fasteners 116 are engaged. Accordingly, both the vertical and horizontal positions of the mounting block relative to the entry point of the fastener from the nose of the hand tool 100 is precisely controlled by the design of this interface. This precise positioning of the mounting block 106 relative to the entry point of the fastener from the nose of the hand tool 100 enables a range of accessories to be supported by the mounting block 106 to enhance operation of the hand tool 100.

The mounting block 106 can typically be formed from any suitable metal such as aluminum or steel and any alloy. Alternately, the mounting block 106 can be produced from strong, durable plastic or other synthetic materials. In addition, those skilled in the art will appreciate that the mounting block 106 can also be constructed as an assembly of components employing different materials. In one example, the mounting block 106 can be produced from a raw extruded aluminum component which undergoes finish machining of key elements, e.g., threaded holes, or other attachment features and any other application-specific elements (e.g. a guide feature).

In one primary example application, the mounting block 106 can support an indexing guide comprising a guide feature 108 which locates the proper position of the fasteners delivered by the hand tool in use. The guide feature 108 shape and position on the mounting block 106 is typically designed for a specific application. It can have any necessary shape for a particular application. However, in many cases, the guide feature 108 can be configured as a post vertically aligned with the delivered fasteners. The size and shape of the guide feature 108 as a post can be made to match a particular hole for a particular application. Typically, the leading edges of the guide feature 108 post will be tapered to better facilitate quick insertion into the indexing hole. Suitable applications for a guide according to the present invention will have a desired fastener location very near another hole or feature (such as an edge) on the workpiece in a repeating manner.

3. Exemplary Accessories for Mounting Block

It is important to note that the novel attachment of the mounting block 106 employing opposing lips 112A, 112B seating against the chamfered edges 110A, 110B of the nose plate 104 can be applied to other suitable accessories as well. For example, a light, e.g. an LED light, can be attached to the nose plate 104 in a similar manner. Other such accessories can be attached in the same position as the mounting block 106 shown or at alternate elevations along the nose plate 104 employing the same attachment device. Typically, a standard set of chamfered edges 110A, 110B on the nose plate 104 can be used to attach different mounting blocks for different accessories such as described hereafter. Furthermore, the mounting block 106 or other accessories can also be attached at different angles in fixed or adjustable positions. A mounting block 106 can be attached with a guide feature 108 vertically, at a fixed angle or at an adjustable position and/or angle. Having the guide feature 108 at an angle allows a user to shoot the staples at an angle relative to a reference on or near the work piece against which the guide feature 108 is rested.

Figure 2A:
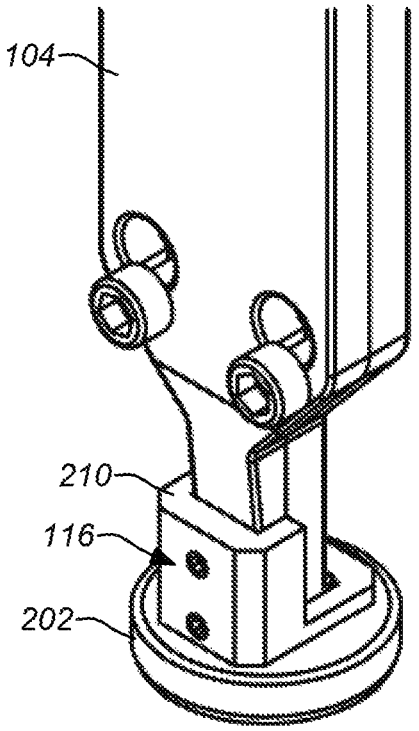
FIGS. 2A and 2B show an example embodiment of the invention for attaching to a nose of a driven fastener hand tool including a non-marring pad.
Figure 2B:
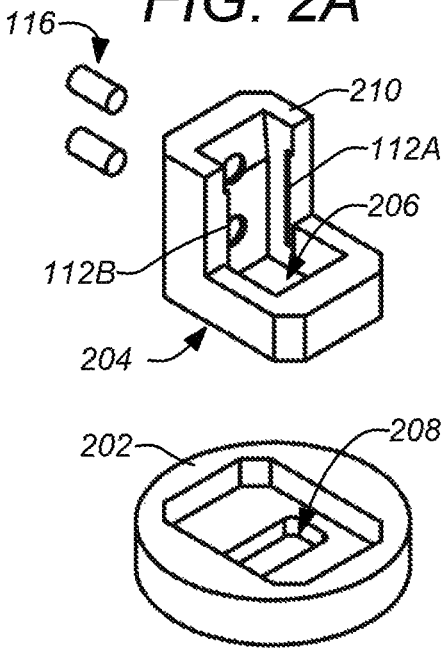

FIGS. 2A and 2B show an example embodiment of the invention for attaching to a nose of a driven fastener hand tool including a non-marring pad 202. FIG. 2A shows the mounting block 210 attached to the nose plate 104 of the driven fastener hand tool 100 and FIG. 2B shows the mounting block 210, fasteners 116, and non-marring pad 202 in an exploded view. Attachment of the mounting block 210 to the nose plate 104 is identical to the attachment of mounting block 106 described above in FIG. 1B, employing mounting block fasteners 116, opposing lips 112A, 112B on the mounting block 106 seating against the chamfered edges 110A, 110B of the nose plate 104. However, in this case the mounting block 210 is configured to support a non-marring pad 202. The mounting block 210 comprises a cupped end 204 having a through hole 206 for the fastener entry point from the hand tool 100. The through hole 206 aligns with a pad through hole 208 when the non-marring pad 202 is installed over the end 204 of the mounting block 210. Those skilled in the art will appreciate that the non-marring pad 202 can be formed into any useful shape.

In the example shown, the pad 202 comprises a disc shape covering the cupped end 204 of the mounting block 210. Those skilled in the art will understand that the non-marring pad 202 can be configured to have any useful shape for various applications. For example, the non-marring pad 202 can be configured to have a conical or pyramid shape with the through hole 208 at the point or a prismatic shape with the through hole 208 along a leading edge. The shape of the non-marring pad 202 can be designed to match the surrounding area of the desired fastener placement for a particular application. Accordingly, differently shaped non-marring pads can be interchangeably used with the mounting block 210.

The non-marring pad 202 can be attached to the mounting block 210 by forming the mounting block 210 and the pad 202 to have interlocking features that can be snapped into coupling or press fit together such that the pad 202 is secured to the block 210 and will not be knocked loose from all but very extreme impacts. For example, a groove can be formed around the inner concave feature in the pad 202 and a matching beading can be formed around the mating perimeter of the mounting block 210. Those skilled in the art will appreciate that many alternate types of snap or press mounting can be employed between the mounting block 210 and the pad 202 depending upon the selected materials of each component. This interface will be identical for differently shaped pads 202 which can be interchangeably employed as described above.

When the mounting block 210 with the non-marring pad 202 is installed, the pad 202 covers the delivery end of the driven fastener hand tool 100 so that the tool can be quickly moved from one position to another without marking or damaging finished surfaces of the workpiece. The non-marring pad 202 can be constructed of any suitable durable non-marring material. Any known suitable plastic, rubber, nylon, or other synthetic material can be used. In one notable example, the non-marring pad 202 can be manufactured from a slick, smooth, and durable material, e.g. polyethylene, such as UHMW polyethylene.

Figure 2C:
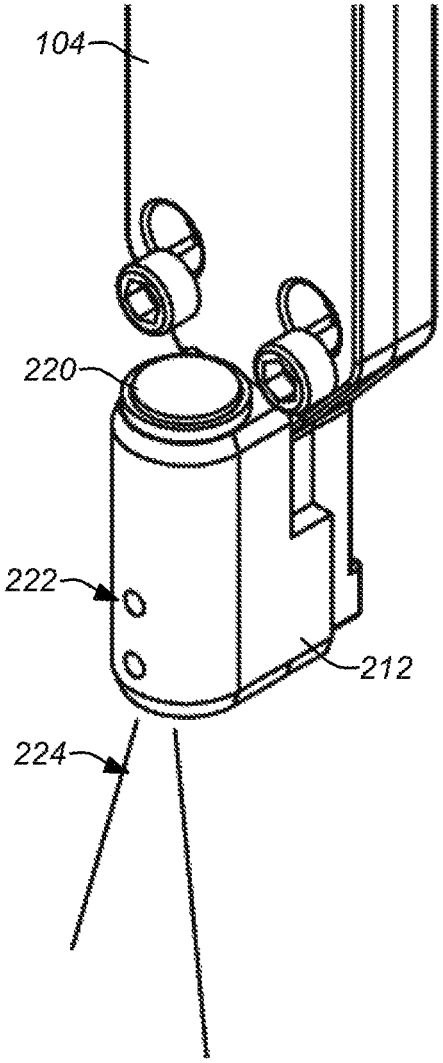
FIGS. 2C and 2D show an example embodiment of the invention for attaching to a nose of a driven fastener hand tool including a light, such as an LED.
Figure 2F:
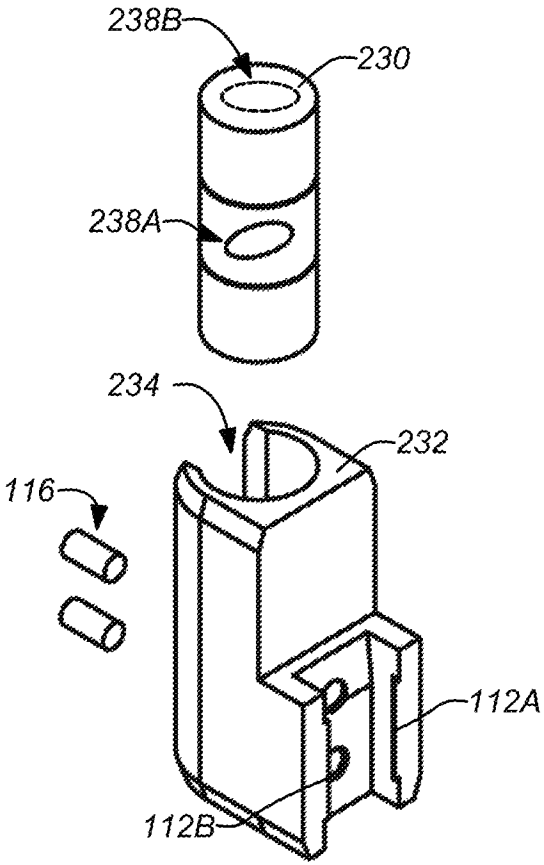
FIGS. 2E and 2F show an example embodiment of the invention for attaching to a nose of a driven fastener hand tool including a level.
Figure 2E:
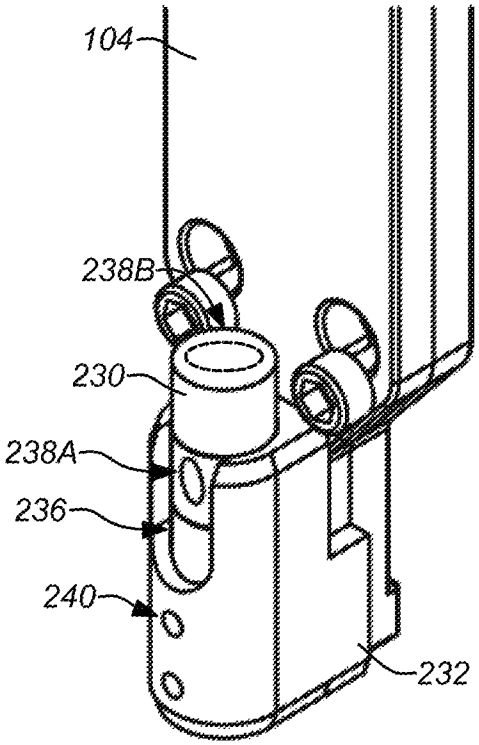
Figure 2D:
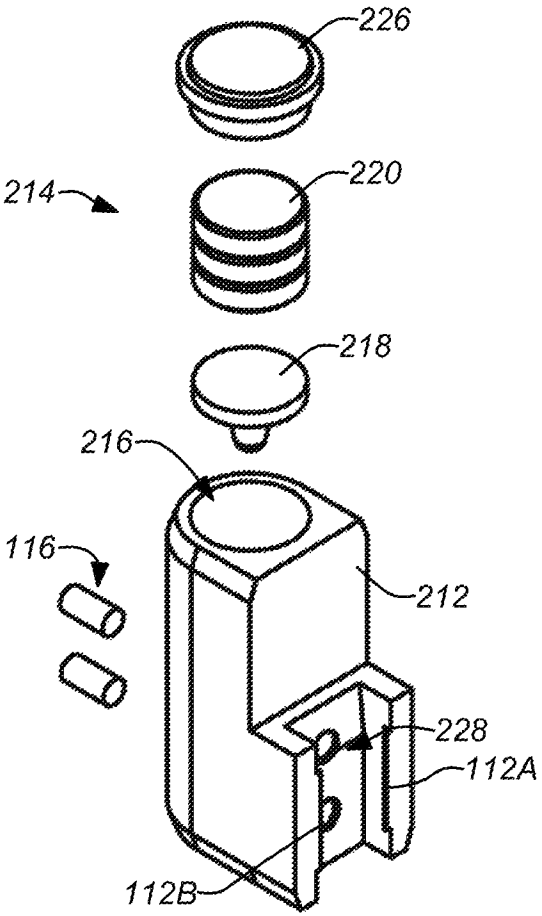

FIGS. 2C and 2D show an example embodiment of the invention attached to a nose of a driven fastener hand tool including a light assembly 214. FIG. 2C shows the mounting block 212 attached to the nose plate 104 of the driven fastener hand tool 100 and FIG. 2D shows the mounting block 212, fasteners 116, and light assembly 214 in an exploded view. Attachment of the mounting block 212 to the nose plate 104 is identical to the attachment of mounting block 106 described above in FIG. 1B, employing mounting block fasteners 116, opposing lips 112A, 112B on the mounting block 212 seating against the chamfered edges 110A, 110B of the nose plate 104.

The mounting block 212 for this accessory includes a vertical cylindrical opening 216 accessed from the top end with a smaller through hole at the bottom end to support the light assembly 214. The light assembly 214 comprises a light board 218, one or more batteries 220 and a cap assembly 226 which are all installed in order within the cylindrical opening 216 in use.

The light board 218 includes the electrical light mounted on a supporting board and which matches the inner diameter of the cylindrical opening 216. Any known suitable electrically powered light can be used. Color and brightness of the light can be varied. For example, the light can comprise an LED (light emitting diode) because such lights are energy efficient and can be very bright. When installed in the cylindrical opening 216, the light on the light board 218 is exposed though the smaller through hole at the bottom end such that it can deliver a light beam 224 to shine onto the work area when the tool 100 is in use.

One or more batteries 220, e.g. any suitable small watch batteries, are stacked on top of the light board 218 to make electrical contact with the light on the board and with each other. The light assembly 214 is then closed out with a cap assembly 226 which includes a top contact for the batteries as well as an switch, e.g. a push button on/off switch. The cap assembly 226 can be either threaded into the cylindrical opening or formed with any known suitable snap fit interface for replacement of the batteries as needed. The electrical circuit from the cap assembly 226 to the light board 218 can be closed either though use of an electrically conductive mounting block 212 which contacts both components or a separate wire or conductive strap running from the light board 218 to the cap assembly 226 within the cylindrical opening 216 along side the one or more batteries 220.

In order to access the fasteners 116 which attach the mounting block 212 to the nose plate 104, through holes 222 are made from the outside of the cylindrical opening 216 and aligned with the threaded holes 228. The threaded holes 228 support the fasteners 116 when the mounting block 212 is attached to the nose plate 104.

FIGS. 2E and 2F show an example embodiment of the invention attached to a nose of a driven fastener hand tool including a level 230. FIG. 2E shows the mounting block 232 attached to the nose plate 104 of the driven fastener hand tool 100 and FIG. 2F shows the mounting block 232, fasteners 116, and level 230 in an exploded view. Attachment of the mounting block 232 to the nose plate 104 is identical to the attachment of mounting block 106 described above in FIG. 1B, employing mounting block fasteners 116, opposing lips 112A, 112B on the mounting block 106 seating against the chamfered edges 110A, 110B, of the nose plate 104. This mounting block 232 is similar to the mounting block 212 for the light of FIGS. 2C and 2D above because the mounting block 232 also includes a vertical cylindrical opening 234. However, the cylindrical opening 234 here also includes a slotted side 236 which allows a user to view a port 238A in the side of the level 230.

The level 230 functions as known levels using a bubble in a trapped liquid visible though a transparent view port 238A. The bubble 2-38A moves as the cylindrical level 230 is tilted transverse to the axis of the cylinder. A "level" reading is indicated when the bubble is trapped in a high spot of the view port 238A and can be seen within precise markings on the transparent view port 238A. Since alignment of the level 230 is critical, the cylindrical opening 234 and level 230 can incorporate a matching key and keyway features on their surfaces to ensure that the level 230 is precisely aligned when installed. The cylindrical opening 234 and level 230 can also include a snap fit interface to secure the level 230 when installed. The port 238A as configured will allow a user to repeatedly apply fasteners precisely horizontal to the ground.

In another configuration, an alternate (or additional) view port 238B can be employed at the cylindrical end of the level 230 (shown with a dashed line). A view port 238B in this location will allow a user to level the tool 100 such that fasteners are delivered vertically (aligned in two dimensions).

Similar to the light assembly 214 of FIGS. 2C and 2D, in order to access the fasteners 116 which attach the mounting block 232 to the nose plate 104, through holes 240 are made from the outside of the cylindrical opening 216 and aligned with the threaded holes 228. The threaded holes 228 support the fasteners 116 when the mounting block 212 is attached to the nose plate 104.

Referring again back to the light assembly 214 embodiment of FIGS. 2C and 2D, the light assembly 214 including the light board 218, one or more batteries 220 and a cap assembly 226 can all be implemented within a separate closed cylindrical housing the same size and shape as the level 230. In this configuration, the light assembly 214 and level 230 can be interchangeably employed with the mounting block 232. The only additional element is a small through hole at the bottom of the cylindrical opening 234 for the light of the light assembly to shine through.

Figure 2G:
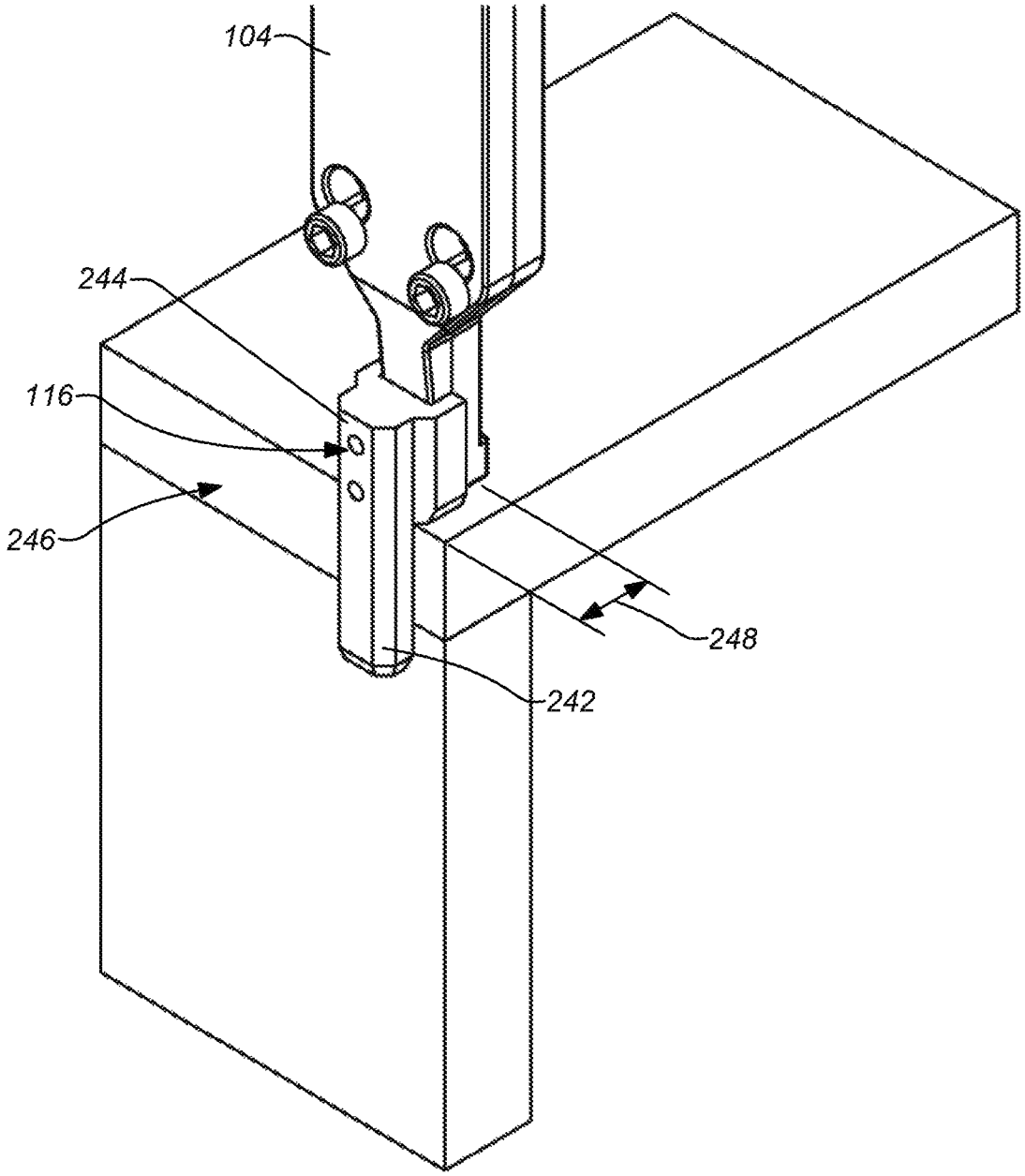
FIGS. 2G and 2H show an example embodiment of the invention for attaching to a nose of a driven fastener hand tool including an edge guide.
Figure 2H:
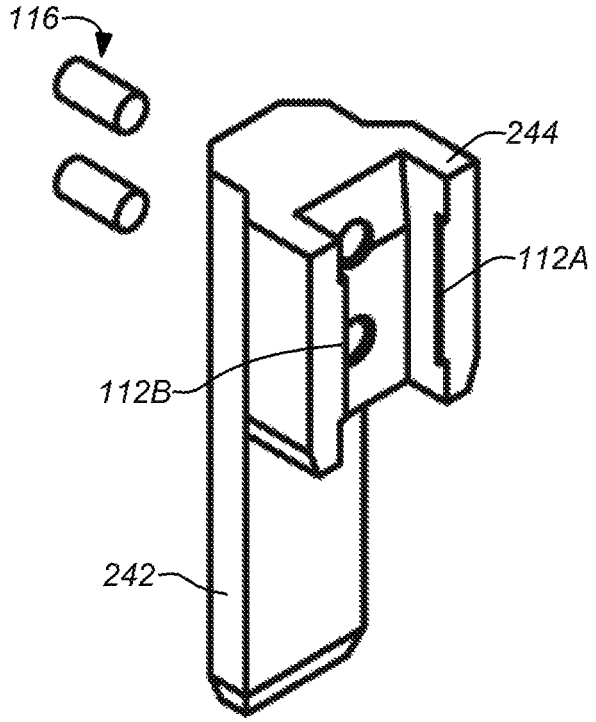

FIGS. 2G and 2H show an example embodiment of the invention attached to a nose of a driven fastener hand tool including an edge guide 242. It should be noted that the edge guide 242 is a specific type of guide feature 108 which has been generally described above regarding FIGS. 1A and 1B (and hereafter regarding FIGS. 3 and 4A to 4D). FIG. 2G shows the mounting block 244 attached to the nose plate 104 of the driven fastener hand tool 100 in use and FIG. 2H shows the mounting block 244 and fasteners 116 in an exploded view. Attachment of the mounting block 244 to the nose plate 104 is identical to the attachment of mounting block 106 described above in FIG. 1B, employing mounting block fasteners 116, opposing lips 112A, 112B on the mounting block 106 seating against the chamfered edges 110A, 110B of the nose plate 104. The mounting block 244 includes an integral edge guide 242 which is configured to provide a flat surface a specific distance 248 from the fastener delivery point as shown. The flat surface of the edge guide 242 is also parallel to the delivered fasteners.

As shown in the FIG. 2G, the edge guide 242 is held flush against a workpiece surface 246 so every fastener will be delivered at precisely the same distance 248 from the workpiece edge, i.e. from the surface 246. In addition, holding the edge guide flush will ensure that each fastener is delivered parallel to the surface 246 as well.

The mounting block 244 including the edge guide 242 is application-specific. Thus, different edge guides 242 having different dimensions for different placement distance 248 can be produced. Typically, a set of different mounting blocks 244 can be produced having different distances in ¼ or ⅛ inch increments.

4. Exemplary Driven Fastener Hand Tool Hole Indexing Guide

Figure 3:
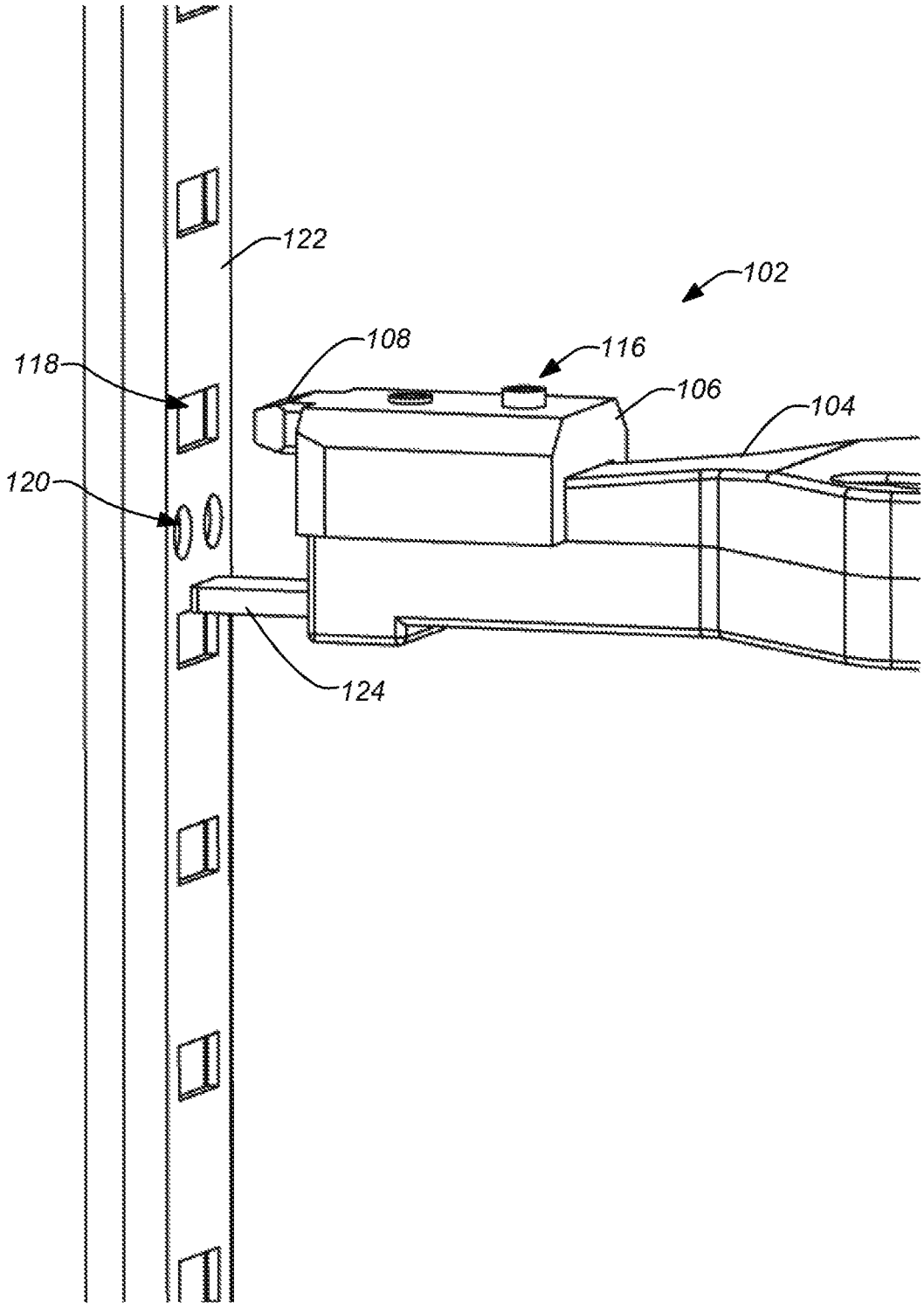
FIG. 3 shows an example embodiment of the invention in use to locate fastener holes in a pilaster.
Figure 4A:
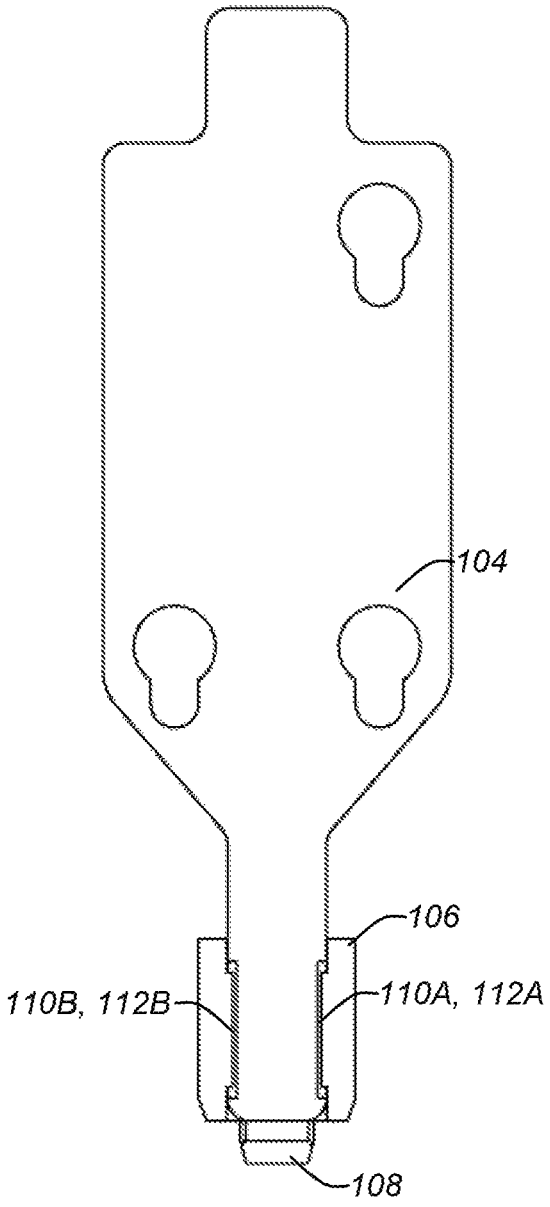
FIGS. 4A to 4D show different views of an example embodiment of the invention attached to the nose end of the channel covering plate for a driven fastener hand tool.
Figure 4B:
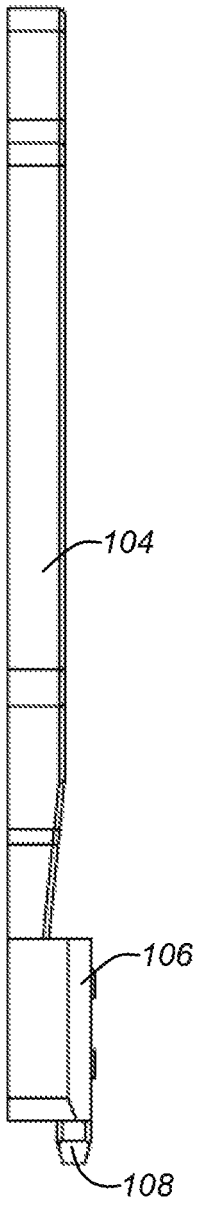
Figure 4C:
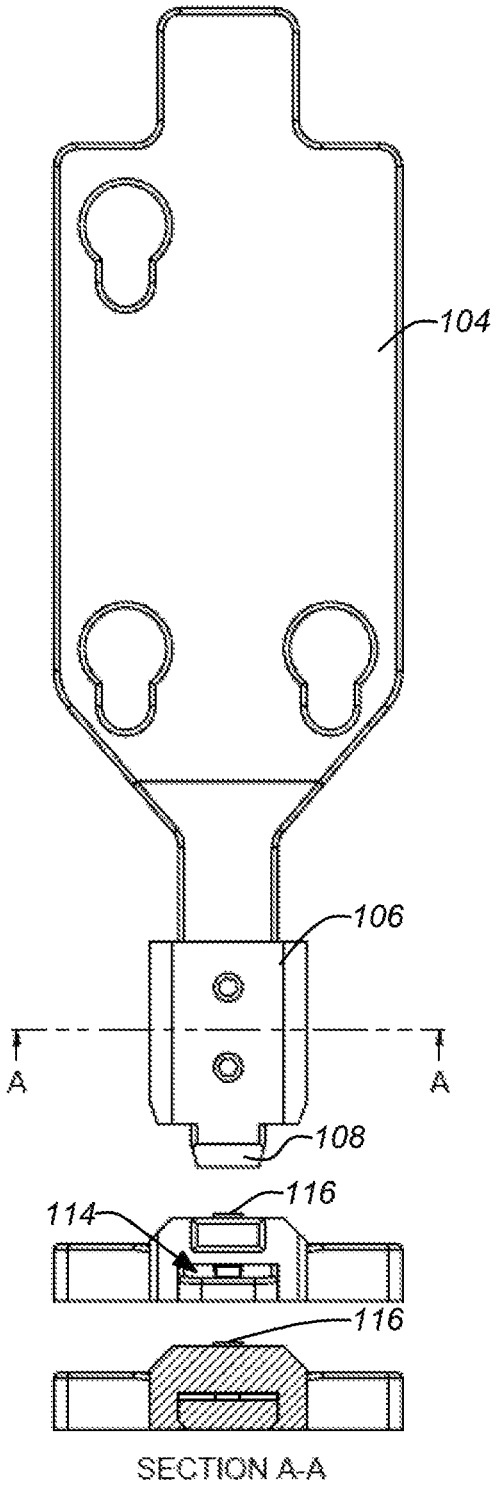
Figure 4D:
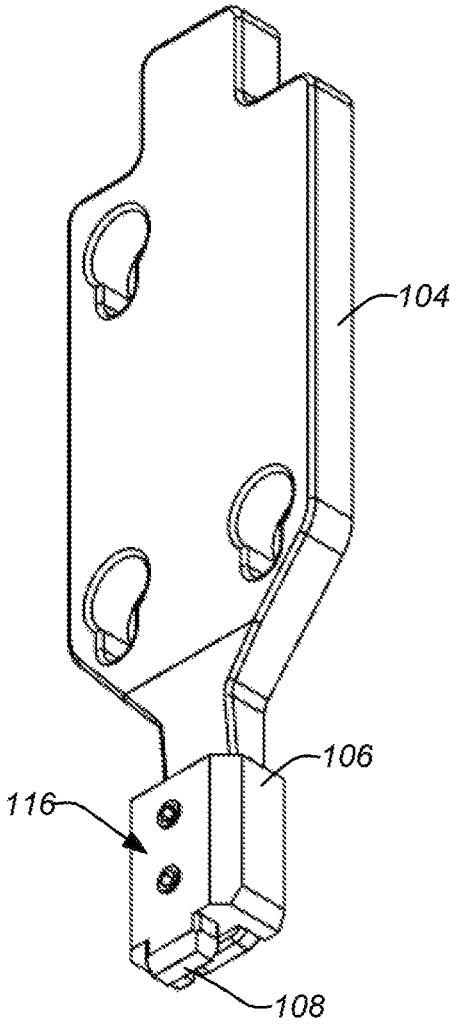

FIG. 3 shows the example embodiment of the invention including a hole indexing guide in use to locate fastener holes 120 in a pilaster 122 for attaching wall mounted supports, such as shelf supports. In this example application, the guide is designed to facilitate precise location of staple fasteners in a pilaster or support post 122 typically vertically fastened to a wall. The support post 122 includes a repeating series of fastener holes 120 along its length. When the guide feature 108 is placed in a matching rectangular hole 118, the entry point at the nose of the driven fastener hand tool is automatically precisely positioned to deliver a staple into two adjacent holes 120 nearby. Most driven fastener hand tools will also employ a safety pin 124 as shown which must be depressed against the workpiece before the fastener hand tool can be fired.

The use of a rectangular shaped guide feature 108 helps to ensure that the fastener position is also rotationally aligned as tool 100 cannot be rotated very far out of position without causing the feature 108 to bind in the matching rectangular hole 118.

Those skilled in the art will appreciate that the novel attachment mechanism is compact and efficient and allows for different guides or other accessories to be employed in different applications. Different application-specific mounting blocks can be readily produced at a low cost. In addition, because most driven fastener hand tools employ a nose plate 104, the guide can be implemented as a retrofit to such tools. Only a very minor modification to the nose plate is required, i.e. forming two chamfered edges 110A, 110B, to enable use with any application-specific mounting block.

FIGS. 4A to 4D show different views of an example embodiment of the invention attached to the nose end of the channel covering plate 104 for a driven fastener hand tool 100. The extra depth of the attachment channel 114 can be seen as a gap between the bottom of the channel 114 and the plate 104 in the end view shown above the section A-A view. The fastener 116 extends from the bottom of the channel 114 to press against the plate 104. This pressing by the fastener (s) 116 causes the opposing lips 112A, 112B of the nose block 106 and chamfered edges 110A, 110B of the nose end 102 of the plate 104 to be forced together, securing the block 106 to the plate 102.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention, may be devised without departing from the inventive concept as set forth in the following claims.

What is claimed is:

1. An accessory attachment for a driven fastener hand tool, comprising:

a mounting block having an attachment channel, the attachment channel having opposing inverted chamfered lips for seating against chamfered edges of a nose end of a plate, the plate for covering a fastener driving channel of the driven fastener tool and having the nose end with the chamfered edges on opposing sides towards the fastener driving channel; and one or more mounting block fasteners disposed through the mounting block at a bottom of the attachment channel to press the nose end of the plate causing the opposing inverted chamfered lips of the mounting block to press against the chamfered edges of the nose end of the plate thereby securing the mounting block to the nose end of the plate;

wherein the chamfered edges engagement with the opposing inverted chamfered lips along matching lengths fix the position of the mounting block along a length of the plate.

2. The accessory attachment of claim 1, wherein the attachment channel of the mounting block has sufficient depth to allow the opposing lips of the mounting block to pass over a width of the nose end of the plate.

3. The accessory attachment of claim 1, wherein the one or more mounting block fasteners comprise threaded fasteners.

4. The accessory attachment of claim 1, wherein a guide feature is affixed to the mounting block.

5. The accessory attachment of claim 4, wherein the guide feature comprises an edge guide.

6. The accessory attachment of claim 4, wherein the guide feature comprises a horizontal post for locating a hole of a shelf support post relative to a fastener location aligned with the fastener driving channel.

7. The accessory attachment of claim 1, wherein a non-marring pad is attached to the mounting block.

8. The accessory attachment of claim 7, wherein the non-marring pad comprises a disc shape over a cupped end of the mounting block.

9. The accessory attachment of claim 1, wherein a light assembly is attached to the mounting block.

10. The accessory attachment of claim 1, wherein a level is attached to the mounting block.

11. The accessory attachment of claim 1, wherein the mounting block comprises a cylindrical opening.

12. The accessory attachment of claim 11, wherein a level is attached to the cylindrical opening of the mounting block.

13. The accessory attachment of claim 11, wherein a light assembly is attached to the cylindrical opening of the mounting block.

14. An accessory attachment for a driven fastener hand tool, comprising:

a mounting block having an attachment channel, the attachment channel having opposing lips for seating against chamfered edges of a nose end of a plate, the plate for covering a fastener driving channel of the driven fastener tool and having the nose end with the chamfered edges on opposing sides towards the fastener driving channel; and one or more mounting block fasteners disposed through the mounting block at a bottom of the attachment channel to press the nose end of the plate causing the opposing lips of the mounting block to press against the chamfered edges of the nose end of the plate thereby securing the mounting block to the nose end of the plate;

wherein a light assembly is attached to the mounting block.

15. The accessory attachment of claim 14, wherein the mounting block comprises a cylindrical opening and the light assembly is attached to the cylindrical opening of the mounting block.

16. An accessory attachment for a driven fastener hand tool, comprising:

a mounting block having an attachment channel, the attachment channel having opposing lips for seating against chamfered edges of a nose end of a plate, the plate for covering a fastener driving channel of the driven fastener tool and having the nose end with the chamfered edges on opposing sides towards the fastener driving channel; and one or more mounting block fasteners disposed through the mounting block at a bottom of the attachment channel to press the nose end of the plate causing the opposing lips of the mounting block to press against the chamfered edges of the nose end of the plate thereby securing the mounting block to the nose end of the plate;

wherein a level is attached to the mounting block.

17. The accessory attachment of claim 16, wherein the mounting block comprises a cylindrical opening and the level is attached to the cylindrical opening of the mounting block.

* * * * *